US005953969A

United States Patent [19]

Rosenhan

[11] Patent Number: 5,953,969

[45] Date of Patent: Sep. 21, 1999

[54] SCREWDRIVER, SCREWDRIVER BIT OR THE LIKE

[75] Inventor: Rolf Günter Rosenhan, Remscheid, Germany

[73] Assignee: Wera Werk Hermann Werner GmbH & Co., Wuppertal, Germany

[21] Appl. No.: 08/913,834

[22] PCT Filed: Mar. 21, 1996

[86] PCT No.: PCT/EP96/01226

§ 371 Date: Sep. 12, 1997

§ 102(e) Date: Sep. 12, 1997

[87] PCT Pub. No.: WO96/32508

PCT Pub. Date: Oct. 17, 1996

[30] Foreign Application Priority Data

Apr. 8, 1995 [DE] Germany ..... 195 13 366

[51] Int. Cl.[6] ..... B25B 13/48

[52] U.S. Cl. ..... 81/436; 81/438; 81/900

[58] Field of Search ..... 81/436, 438, 439, 81/900

[56] References Cited

U.S. PATENT DOCUMENTS 2,627,192 2/1953 Jenney, Jr. et al. .
5,704,261 1/1998 Strauch et al. ..... 81/900

FOREIGN PATENT DOCUMENTS 0608711 8/1994 European Pat. Off. .
2682685 4/1993 France .
1503028 11/1970 Germany .
3839788 11/1989 Germany .

OTHER PUBLICATIONS

Lampman et al, "Metals Handbook 10th Ed. vol. 1, p. 793–800" 1990 ASM, Metals Park, Oh. US XP002009427 167750.

VDI Z. vol. 118, No. 21. 1976, Düsseldorf Germany, pp. 997–1003, XP002009426 K. Vetter, "Werkstoffeinflüsse auf oberflächengehartete Bauteile".

Werkzeuge aus martensitaushärtendem Stahl, Dr.–Ing. H. Berns, Düsseldorf, (1971) No. 6, p. 292.

*Primary Examiner*—Timothy V. Eley
*Assistant Examiner*—Sinclair Skinner
*Attorney, Agent, or Firm*—Martin A. Farber

[57] ABSTRACT

A screwdriver or screwdriver bit comprising a working end with radially extending engagement surfaces profiled in particular by machining or forming. A surface layer forming a working surface due to nitriting has a hardness of at least 900 HV 0.3 or 67–68 HRC and in an intermediate layer, lying between the hard surface layer and a softer region of a core of the working end, the hardness decreases with a hardness gradient of 1500 to 3000 HV 0.3/mm.

10 Claims, 2 Drawing Sheets

HV0, 3
HRc 900
800
700
600
68
67
66
65
64
63
62
61
60
59
58
57
56
55
54
II
I
D
d
0
0, 05
0, 10
0, 15
0, 20
0, 25
0, 30
mm

SCREWDRIVER, SCREWDRIVER BIT OR THE LIKE

FIELD OF BACKGROUND OF THE INVENTION

The present invention relates to a screwdriver, screwdriver bit or the like.

Such tools are made of steel. As manufacturing process, machining and forming and well as compressing are known. The tools have a working end which may be developed in cruciform shape if the tool is to be suitable for use with Phillips screws. The tool has working surfaces on its working end with which corresponding mating surfaces in the opening in the screw head are to be acted on. Various attempts have been made in the past permanently to shape such tools which are formed of steel. One known method is to coat the working end of the tool with a hard material, for instance titanium nitrite. In this way, a surface layer on the working end is harder than the core of the working end. However, it has been found that such layers applied by the CVD or PVD process from a material other than the material of the core can tear and chip off when the tool is used.

If the tip of a known tool, for instance a Phillips screwdriver, is inserted into the corresponding opening in a screw head, all the working surfaces do not act simultaneously on the corresponding opening surfaces in the screw head due to the tolerances in the tool and the opening in the screw head. If a torque is now exerted, then, in the case of a hard work end, only a punctiform load is exerted on individual engagement surfaces which would have the result that the surfaces are easily overstressed and then break. One theoretically conceivable solution for preventing this breaking-off of the engagement flanks would be maintaining the precise geometry. This is not feasible from the standpoint of manufacture.

An alternative for this are bits of a tough material so that the flanks of the working end deform upon being subjected to load and thus all four flanks come into engagement substantially uniformly. Such tools have a useful life. On the other hand, however, wear of the tool can in particular be noted if, in case of too high a torque, the working end slips out of the screw head and then continues spinning.

It is furthermore contemplated to develop the tools with a hard center and then, by a targeted heat treatment, have the hardness decrease towards the surface. Such tools show favorable properties in laboratory tests but in actual practice they wear in the same way as tools which are soft throughout. The above-mentioned coating of a soft tool with hard material led to the above-indicated problems. The layer of hard material, to be sure, results initially in a certain minimizing of the wear, but this layer tends to tear under the varying load and then peel off. The tool then wears down in the same manner as all other tools.

SUMMARY OF THE INVENTION

The object of the present invention is therefore to produce, starting from the known prior art, a tool which wears less.

As a result of the development in accordance with the invention a tool is obtained in which the layer of material lying directly below the surface is of greater hardness than the core. In this connection, to be sure, the hardness does not decrease suddenly as in the prior art but an intermediate layer is provided in which the hardness decreases continuously to the value of the core. In such screwdrivers, to be sure, the formation of a crack is also observed after a large number of alternations of load, but there is no enlargement of the crack or peeling-off of the harder layer, as is the case in the prior art. The hard surface layer, the intermediate layer and the core material are of identical material with only a different hardness or different structure. The resistance to wear of the tool has increased as a result of this development. The intermediate layer preferably has a thickness of 0.05 to 0.2 mm and has a hardness gradient of 1500 to 3000 HV 0.3/mm. The surface layer, which is the hardest layer and which the intermediate layer adjoins, has a thickness of 0.05 to 0.1 mm and a hardness of 900 HV 0.3 or 67–68 HRC. In this connection, the core hardness should lie below 700 HV 0.3. The preferred embodiment provides that the core, the surface layer and the intermediate layer consist of the same maraging steel. In this connection the core, as a result of a heat treatment, should have a hardness of 54 to 58 Rockwell and the surface layer, as a result of nitriting, should have a hardness of 67–68 Rockwell. As material, a maraging steel is to be used. The alloy is preferably refined in a vacuum. This steel is first of all brought into a shape corresponding to the tool. This is done by forming or machining. The tool is then heat-treated in such a manner that the core reaches a hardness of 54–58 HRC. In this connection a plastic deformability of 5 to 10% should be obtained. This deformability can, for instance, be measured in a tensile test. In accordance with the invention, this heat treatment—age-hardening or precipitation-hardening—is to be combined with plasma nitrating. This plasma nitrating is carried out in such a manner that a hardening of more than 900 HV 0.3 down into a depth of 0.05–0.1 mm is obtained (this corresponds to a hardness of 67–68 Rockwell). By this plasma nitrating, the positive properties of the material of the core are not affected. In the region of the surface, however, the hardness of the material then increases continuously within the intermediate layer up into a thin surface layer which has a corresponding harness. The tool produced thereby wears about 10 times less than known tools do. The final tool has a hard outer wall which, upon torsion stressing, can form a spring-like restoring element. The tough core can in this connection form a sort of damping member if this material is plastically or dissipatively deformable. It is essential in the invention that the variation in hardness from the surface to the core is not sudden but continuous. With regard to the nature and the composition of maraging steel, reference is had to the article by H. Berns of Dusseldorf entitled "Tools of Maraging Steel" in ZwF 66 (1971) No. 6, page 292. The material should contain molybdenum. The nitration can then be carried out in a stream of gas at 430° C. to 500° C. In this connection the desired surface hardnesses of 900 HV are obtained. However, it is also possible to effect the nitrating in a soft nitriding bath at about 550 degrees Celsius. This also results in the required hardness of the surface. The hardness of the core, however, remains unaffected.

DETAILED DESCRIPTION OF THE PREFERRED EMBODIMENT

Figure 1:
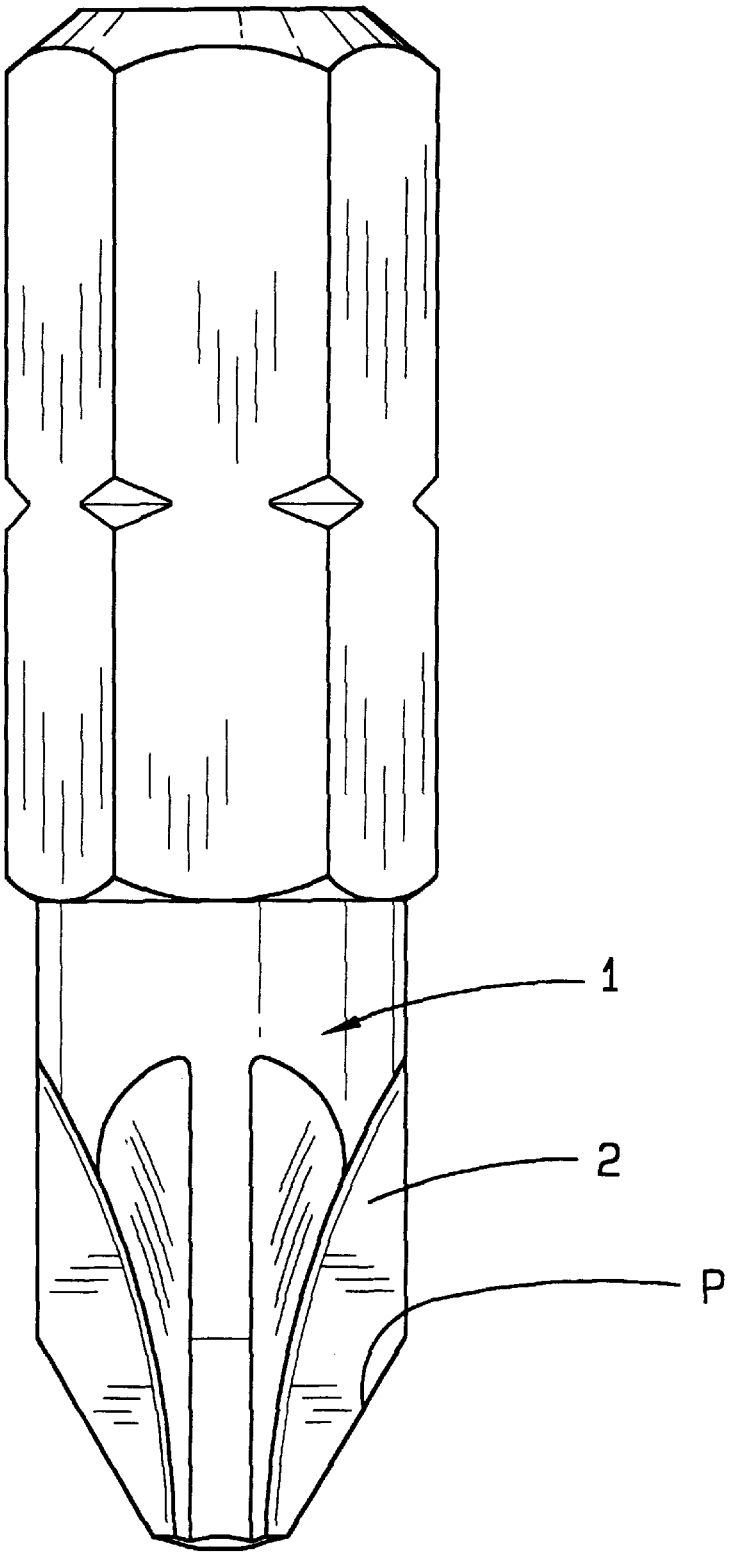
FIG. 1 shows a screwdriver in accordance with the invention.

The bit shown in FIG. 1 consists of a maraging steel which, after suitable heat treatment with combined plasma nitration, has a core hardness of 54–58 Rockwell with high toughness, and a surface hardness of 67–68 Rockwell. The bit has a working end 1 with working flanks 2.

Figure 2:
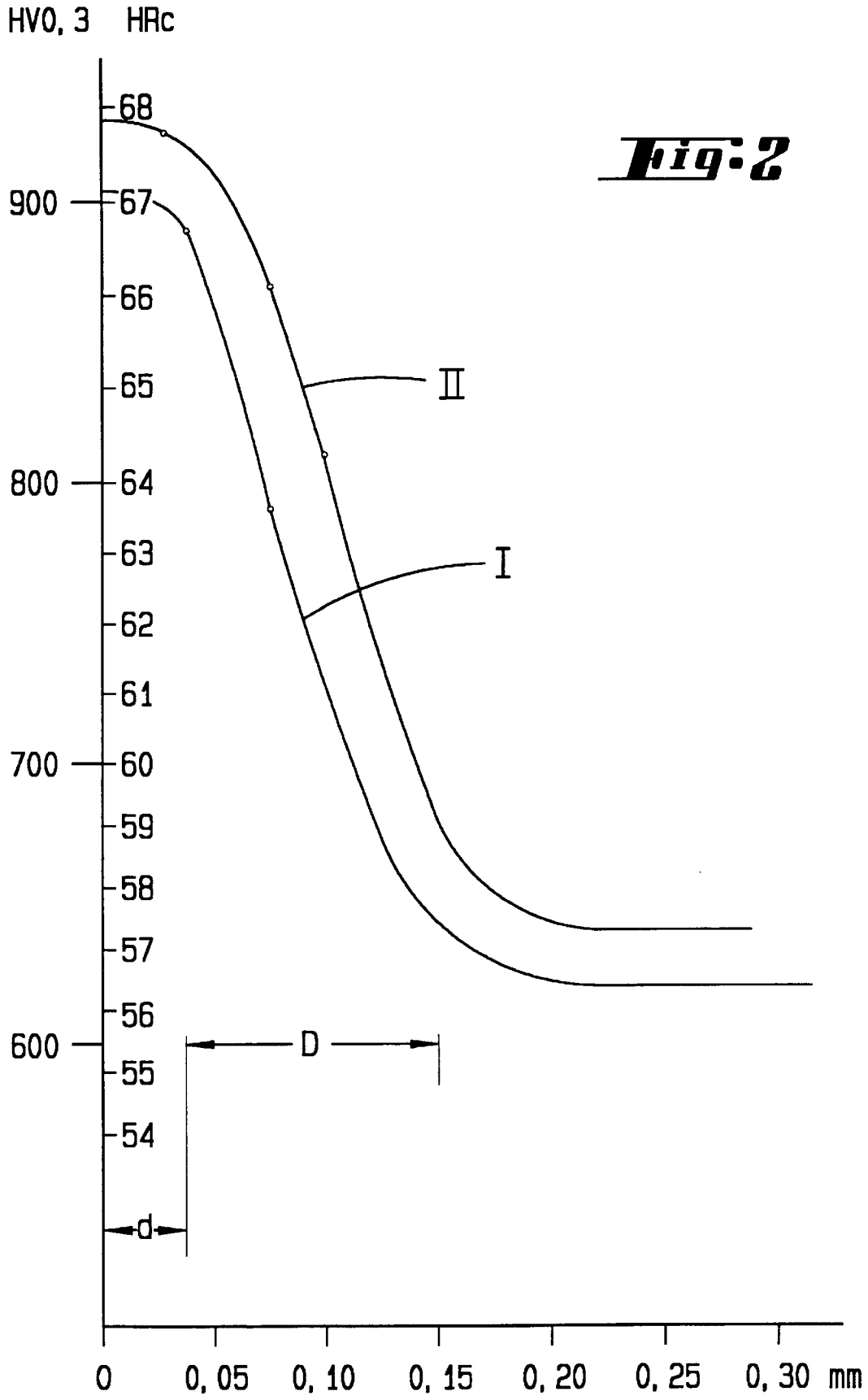
FIG. 2 shows the variation of the hardness at the point P in the tool of FIG. 1 at a distance from the surface.

FIG. 2 shows a typical course of the hardness of the material with increasing depth of surface on the basis of two examples I and II. In the region of the core, i.e. in a depth of more than 0.2 mm, the hardness of the core is within a range of 54 to 58 Rockwell.

In a surface layer the thickness d of which is about 0.04 mm, the hardness is more than 67 Rockwell or more than 900 Vickers. In the embodiment shown, the hardness is between 67 and 68 Rockwell. Within the surface layer of the thickness d, the hardness changes only slightly. The surface layer d adjoins, in the direction towards the core in a depth of about 0.04 to 0.01 mm, an intermediate layer of a thickness D. In the embodiment shown, the thickness of the intermediate layer is abut 0.1 mm. The thickness D of the intermediate layer can, however also be less, namely 0.05 mm, or greater up to 0.2 mm. Within the intermediate layer the hardness of the material drops continuously over the length D. In other words, a hardness gradient is formed here. The hardness gradient amounts for instance to 1500 to 3000 Vickers/mm. If a bit in connection with which, at the point P in the region of the working surface, such a course of the hardness is developed with the same material, is loaded in accordance with its use, then a deformation does occur, but the hard surface layer of the layer thickness d does not split off, since it is connected, over a continuous decrease in hardness, in the same structure to the core structure. It has been found that while cracks form in the surface, they do not increase if the torques upon engagement are maintained within the corresponding limits. The stresses applied to the surface are continued continuously up into the core due to the absence of an artificial boundary layer.

I claim:

1. A screwdriver comprising a working end with radially extending engagement surfaces profiled in particular by machining or forming, wherein a surface layer forming a working surface due to nitriting has a hardness of at least 900 HV 0.3 or 67–68 HRC and in an intermediate layer, lying between the hard surface layer and a softer region of a core of the working end, the hardness decreases with a hardness gradient of 1500 to 3000 HV 0.3/mm.

2. A screwdriver according to claim 1 wherein the intermediate layer has a thickness between 0.05 and 0.2 mm.

3. A screwdriver in accordance with claim 1, wherein the surface layer extends down to a depth of 0.05 to 0.1 mm and the hardness of the core is less than 700 HV 0.3.

4. A screwdriver according to claim 1, wherein the core, the surface layer and the intermediate layer are made of the same maraged steel, the core having a hardness of 54 to 56 HRC as a result of heat treatment.

5. A method of producing a screwdriver according to claim 1, comprising the steps of subjecting a blank formed of maraging steel to a combined heat treatment and plasma nitriding, such that a layer forming the surface directly below the surface is hardened up to at least 900 HV 0.3 or 67–69 HRC and is harder than the region of the core, and an intermediate layer in which the hardness decreases continuously with increasing depth with a hardness gradient of 1500 to 3000 HV 0.3/mm is formed between the core and the surface layer.

6. A screwdriver bit comprising a working end with radially extending engagement surfaces profiled in particular by machining or forming, wherein a surface layer forming a working surface due to nitriting has a hardness of at least 900 HV 0.3 or 67–68 HRC and in an intermediate layer, lying between the hard surface layer and a softer region of a core of the working end, the hardness decreases with a hardness gradient of 1500 to 3000 HV 0.3/mm.

7. A screwdriver bit according to claim 6, wherein the intermediate layer has a thickness between 0.05 and 0.2 mm.

8. A screwdriver bit in accordance with claim 6, wherein the surface layer extends down to a depth of 0.05 to 0.1 mm and the hardness of the core is less than 700 HV 0.3.

9. A screwdriver bit according to claim 6, wherein the core, the surface layer and the intermediate layer are made of the same maraged steel, the core having a hardness of 54 to 56 HRC as a result of heat treatment.

10. A method of producing a screwdriver bit according to claim 6, comprising the steps of subjecting a blank formed of maraging steel to a combined heat treatment and plasma nitriding, such that a layer forming the surface directly below the surface is hardened up to at least 900 HV 0.3 or 67–69 HRC and is harder than the region of the core, and an intermediate layer in which the hardness decreases continuously with increasing depth with a hardness gradient of 1500 to 3000 HV 0.3/mm is formed between the core and the surface layer.

* * * * *